US011162733B2

(12) United States Patent
Hayton et al.

(10) Patent No.: US 11,162,733 B2
(45) Date of Patent: Nov. 2, 2021

(54) LANCE UNBLOCKING METHOD AND APPARATUS

(71) Applicant: Tata Steel Limited, Mumbai (IN)

(72) Inventors: Mark Hayton, Bateman (AU); Rodney James Dry, City Beach (AU); Jacques Pilote, Woodlands (AU)

(73) Assignee: Tata Steel Limited, Mumbai (IN)

( * ) Notice: Subject to any disclaimer, the term of this patent is extended or adjusted under 35 U.S.C. 154(b) by 197 days.

(21) Appl. No.: 15/551,526

(22) PCT Filed: Feb. 16, 2016

(86) PCT No.: PCT/AU2016/050102
§ 371 (c)(1),
(2) Date: Aug. 16, 2017

(87) PCT Pub. No.: WO2016/131097
PCT Pub. Date: Aug. 25, 2016

(65) Prior Publication Data

US 2018/0038650 A1 Feb. 8, 2018

(30) Foreign Application Priority Data

Feb. 17, 2015 (AU) ..... 2015900516

(51) Int. Cl.
*F27D 25/00* (2010.01)
*B08B 9/032* (2006.01)
(Continued)

(52) U.S. Cl.
CPC ..... *F27D 25/001* (2013.01); *B08B 9/0328* (2013.01); *B08B 9/045* (2013.01);
(Continued)

(58) Field of Classification Search
CPC ..... F27D 25/001; F27D 25/008; F27D 3/18; F27D 25/00; B08B 9/0328; B08B 9/045;
(Continued)

(56) References Cited

U.S. PATENT DOCUMENTS 3,516,651 A * 6/1970 Honda ..... C21B 7/00 266/197
3,618,917 A * 11/1971 Fredrikson ..... C21C 5/5241 266/220
(Continued)

FOREIGN PATENT DOCUMENTS

JP 2001342508 A 12/2001
JP 2002038867 A * 2/2002
(Continued)

OTHER PUBLICATIONS

Description of JP 2001342508.*
May 9, 2016—International Search Report and Written Opinion of PCT/AU2016/050102.

*Primary Examiner* — Alexander Markoff
(74) *Attorney, Agent, or Firm* — Banner & Witcoff, Ltd.

(57) ABSTRACT

A method of removing a blockage in a solids injection lance under normal operating conditions of a direct smelting vessel is disclosed. The direct smelting vessel contains a bath of molten metal and slag and the solids injection lance extends into the direct smelting vessel and has an outlet end that is submerged in the molten slag. The solids injection lance further has a single inlet coupled to a section of supply line that conveys gas and solid feed material to the solids injection lance. The method comprises (a) advancing a blockage-removing tool through the supply line section and through the solids injection lance to an upstream side of the blockage, (b) operating the tool under elevated gas pressure conditions to remove the blockage such that solid feed material and gas are able to flow through the solids injection
(Continued)

lance. The method further comprises (c) retracting the tool from the solids injection lance and the supply line section. Also disclosed is an apparatus for removing a blockage in a solids injection lance extending into a direct smelting vessel.

11 Claims, 5 Drawing Sheets

(51) Int. Cl.

| | |
|---|---|
| ***F27B 3/18*** | (2006.01) |
| ***F27D 3/18*** | (2006.01) |
| ***C21C 5/46*** | (2006.01) |
| ***B08B 9/045*** | (2006.01) |
| *C21B 13/00* | (2006.01) |
| *C21C 5/56* | (2006.01) |

(52) U.S. Cl.
CPC ..... *C21C 5/4613* (2013.01); *F27B 3/18* (2013.01); *F27D 3/18* (2013.01); *F27D 25/008* (2013.01); *C21B 13/0013* (2013.01); *C21C 5/56* (2013.01)

(58) Field of Classification Search
CPC . C21C 5/4613; C21C 5/56; C21C 5/46; F27B 3/18; C21B 13/0013; C21B 7/16
See application file for complete search history.

(56) References Cited

U.S. PATENT DOCUMENTS 4,637,590 A * 1/1987 Schneider ..... C21B 7/12 266/272
4,802,655 A * 2/1989 Bates ..... B22D 1/005 266/218
5,005,807 A * 4/1991 Mathews ..... C21B 7/12 266/271
5,069,430 A * 12/1991 Woodings ..... C21B 7/12 266/271
5,169,256 A * 12/1992 Woodings ..... E21B 17/0426 285/390
5,735,647 A * 4/1998 Woodings ..... C21B 7/12 173/32
6,835,229 B2 12/2004 Brown et al.
7,422,622 B2 9/2008 Leigh
7,700,035 B2 4/2010 Orth et al.
2003/0071399 A1* 4/2003 Leigh ..... C21B 13/00 266/267
2004/0031355 A1* 2/2004 Dry ..... C21B 11/00 75/502
2005/0127581 A1* 6/2005 Leigh ..... C21B 13/00 266/176
2006/0124306 A1* 6/2006 Vail, III ..... E21B 7/20 166/285
2007/0272058 A1* 11/2007 Orth ..... C21B 5/023 75/502
2008/0128128 A1* 6/2008 Vail ..... E21B 4/18 166/250.15
2009/0057964 A1* 3/2009 Colavito ..... C21C 7/0056 266/44
2010/0287992 A1* 11/2010 Hayton ..... F27B 3/04 65/324
2011/0180978 A1* 7/2011 Goedert ..... F27B 1/16 266/47
2014/0239562 A1* 8/2014 Dry ..... C21C 5/527 266/216
2014/0263703 A1* 9/2014 Waitlevertch ..... B01F 7/005 239/9
2015/0284816 A1* 10/2015 Sakaguchi ..... C21B 5/006 266/78
2016/0017458 A1* 1/2016 Pilote ..... C22B 5/10 266/216

FOREIGN PATENT DOCUMENTS

KR 101277243 B1 * 6/2013
WO 9631627 A1 10/1996
WO 00/022176 A1 4/2000
WO 2013/029092 A1 3/2013

* cited by examiner

LANCE UNBLOCKING METHOD AND APPARATUS

CROSS-REFERENCE TO RELATED APPLICATIONS

The present application is a U.S. National Phase filing of International Application No. PCT/AU2016/050102, filed on Feb. 16, 2016, and claiming priority to Australian Patent Application No. 2015900516 filed Feb. 17, 2015. The present application claims priority to and the benefit of all the above-identified applications, which are all incorporated by reference herein in their entireties.

TECHNICAL HELD

The present invention relates to removing blockages in a solids injection lance. More particularly, the invention relates to a method and apparatus for removing blockages in a solids injection lance.

The present invention relates particularly, although not exclusively, to solids injection lances of a direct smelting vessel, such as a molten bath-based direct smelting vessel for producing molten metal, such as iron, in a direct smelting process.

The invention has application to molten bath-based metallurgical processes that involve injecting solid materials under pressure into the molten bath via an outlet submerged in the molten bath. The invention also has application to plants and processes that involve conveying solid feed materials by entrainment.

BACKGROUND ART

A known molten bath-based smelting process is generally referred to as the "HIsmelt" process and is described in a considerable number of patents and patent applications in the name of the applicant.

The HIsmelt process is applicable to smelting metalliferous material generally but is associated particularly with producing molten iron from iron ore or another iron-containing material:

In the context of producing molten iron, the HIsmelt process includes the steps of:

(a) forming a bath of molten iron and slag in a main chamber of a direct smelting vessel;

(b) injecting into the molten bath: (i) iron ore, typically in the form of fines; and (ii) a solid carbonaceous material, typically coal, which acts as a reductant of the iron ore feed material and a source of energy; and (c) smelting iron ore to iron in the bath.

The term "smelting" is herein understood to mean thermal processing wherein chemical reactions that reduce metal oxides take place to produce molten metal.

Another known process for smelting a metalliferous material is referred to hereinafter as the "HIsarna" process. The process is carried out in a smelting apparatus that includes (a) a smelting vessel that includes solids injection lances and oxygen-containing gas injection lances and is adapted to contain a bath of molten metal and (b) a smelt cyclone for pre-treating a metalliferous feed material that is positioned above and communicates with the smelting vessel. The HIsarna process and apparatus are described in International application PCT/AU99/00884 (WO 00/022176) in the name of the applicant.

In the HIsmelt process solid feed materials in the form of metalliferous material (which may be pre-heated) and carbonaceous material and optionally flux material are injected with a carrier gas into the molten bath through a number of water-cooled solids injection lances which are inclined to the vertical so as to extend downwardly and inwardly through the side wall of the main chamber of the smelting vessel and into a lower region of the vessel so as to deliver at least part of the solid feed materials into the metal layer in the bottom of the main chamber. The solid feed materials and the carrier gas penetrate the molten bath and cause molten metal and/or slag to be projected into a space above the surface of the bath and form a transition zone. A blast of oxygen-containing gas, typically oxygen-enriched air or pure oxygen, is injected into an upper region of the main chamber of the vessel through a downwardly extending lance to cause post-combustion of reaction gases released from the molten bath in the upper region of the vessel. In the transition zone there is a favourable mass of ascending and thereafter descending droplets or splashes or streams of molten metal and/or slag which provide an effective medium to transfer to the bath the thermal energy generated by post-combusting reaction gases above the bath.

Typically, in the case of producing molten iron, when oxygen-enriched air is used, the oxygen-enriched air is generated in hot blast stoves and fed at a temperature of the order of 1200° C. into the upper region of the main chamber of the vessel. If technical-grade cold oxygen is used, the technical-grade cold oxygen is typically fed into the upper region of the main chamber at or close to ambient temperature.

Off-gases resulting from the post-combustion of reaction gases in the smelting vessel are taken away from the upper region of the smelting vessel through an off-gas duct.

The smelting vessel includes a main chamber for smelting metalliferous material and a forehearth connected to the main chamber via a forehearth connection that allows continuous metal product outflow from the vessel. The main chamber includes refractory-lined sections in a lower hearth and water-cooled panels in side walls and a roof of the main chamber. Water is circulated continuously through the panels in a continuous circuit. The forehearth operates as a molten metal-filled siphon seal, naturally "spilling" excess molten metal from the smelting vessel as it is produced. This allows the molten metal level in the main chamber of the smelting vessel to be known and controlled to within a small tolerance this is essential for plant safety.

In the HIsarna process, carbonaceous feed material (typically coal) and flux (typically burnt lime) are injected into a molten bath in the smelting vessel via solids injection lances.

The solid feed materials in both the HIsmelt and HIsarna, processes are typically in the form of fines and, under certain circumstances, a blockage of solid feed materials may occur in a liner of a solids injection lance.

One option for resolving this problem is to remove the blocked liner from the lance and to replace it with another liner. Another option is to drill out the blockage under atmospheric pressure conditions. This latter option requires production to stop and a slag layer of the molten bath to be partly tapped. Additionally, the blocked lance must be depressurised prior to being drilled or changed. The smelting process then needs to be restarted by replacing the tapped slag and by ramping up supply of solid feed material over a period of time.

The present invention provides a method of removing a blockage in a solids injection lance without a complete production stoppage and slag draining.

The above description is not to be taken as an admission of the common general knowledge in Australia or elsewhere.

SUMMARY OF TIE DISCLOSURE

The present invention is a method of removing a blockage in a solids injection lance under normal operating conditions of a direct smelting vessel containing a bath of molten metal and slag, wherein the solids injection lance extends into the direct smelting vessel and has an outlet end that is submerged in the molten slag and has a single inlet coupled to a section of supply line that conveys gas and solid teed material to the solids injection lance, the section of supply line is upstream and co-axial with the solids injection lance, the method comprising:

(a) advancing a blockage-removing tool through the supply line section and through the solids injection lance to an upstream side of the blockage;

(b) operating the tool under elevated gas pressure conditions to remove the blockage such that solid feed material and gas are able to flow through the solids injection lance and into the direct smelting vessel, the gas pressure conditions are elevated such that slag is prevented from entering an outlet end of the lance; and (c) retracting the tool from the solids injection lance and the supply line section.

Removal of the blockage in this manner avoids the need to remove and replace the liner from the solids injection lance when it becomes blocked. This means that it is not necessary to stop production. It also means that it is not necessary to partly drain the slag inventory so that the molten slag in the bath is below of the outlet end of a lance. Reverting to normal production rates after these steps involves restoring the slag inventory because the slag inventory is important for operation of the HIsmelt process and involves ramping up supply of metalliferous material over a period of time to ensure that the temperature of the molten bath is maintained at an optimum temperature for smelting. The compound effect of both prolongs the time to return to normal production rates. The method described above, therefore, enables production to continue, albeit at a reduced rate, and reduces the time to return to normal production rates.

Under normal operating conditions, the solids injection lance is supplied with solids entrained in a carrier gas at a pressure higher than a gas pressure in the direct smelting vessel and the method may include maintaining the supply of carrier gas so that the supply line section and the lance upstream of the blockage remain at a pressure higher than the gas pressure in the direct smelting vessel.

The method may include ceasing supply of the carrier gas and may include providing the elevated gas pressure conditions by supplying a pressurised purge gas to the solids injection lance upstream of the blockage such that, upon removal of the blockage, the purge gas flows into the direct smelting vessel.

The method may further comprise re-commencing supply of the carrier gas after the blockage is removed and reducing and ultimately ceasing the supply of purge gas after commencing supply of the carrier gas.

The method may further comprise depressurising the solids injection lance and the upstream supply line section upstream of the blockage, advancing the blockage-removing tool to the blockage and re-pressurising the solids injection lance and the supply line section before operating the blockage-removing tool to remove the blockage.

Re-pressurising the solids injection lance and the supply line section may comprise supplying a purge gas to the supply line section and to the solids injection lance upstream of the blockage. Alternatively, re-pressurising the solids injection lance and the supply line section may comprise re-commencing supply of the carrier gas The pressure in the direct smelting vessel may be, under normal operating conditions, between 0.5 barg and 1.2 barg.

The method may further comprise after step (a) and prior to step (b) purging loose solid material from the solid injection lance and the section.

The tool may be a drill and the method may involve removing the blockage by drilling through the blockage.

Removing the blockage may involve drilling into the blockage adjacent an internal side wall of the solids injection lance to weaken the blockage at an interface with the side wall.

Step (b) may involve connecting the tool to a series of extension bars and advancing the bars into the supply line section and the solids injection lance until the tool reaches the blockage.

The entrained solid material may include metalliferous material.

The entrained solid material may include metalliferous material and carbonaceous material.

The entrained solid material may include metalliferous material, carbonaceous material, and flux material.

The metalliferous material may be iron ore. The iron ore may be pre-heated to a temperature of at least 500° C. The iron ore may be in the form of fines.

The entrained solid material may include carbonaceous material.

The carbonaceous material may be coal.

The invention extends to situations in which there is only metalliferous material injected into the direct smelting vessel by the lance.

The invention extends to situations in which there is only carbonaceous material injected into the direct smelting vessel by the lance.

The invention is also an apparatus for removing a blockage in a solids injection lance extending into a direct smelting vessel, the solids injection lance having a single inlet coupled to a section of supply line that conveys gas and solids to the solids injection lance and that is upstream and co-axial with the solids injection lance, the apparatus comprising a tool that extends through the supply line section and the solids injection lance to remove a blockage of solid material and an assembly for advancing the tool through the solids injection lance and the supply line section to the blockage from an upstream side of the blockage.

The apparatus may further comprise a gas-pressure seal that enables gas pressure within the solids injection lance and the supply line section to be maintained above the gas pressure in the direct smelting vessel during normal operation while the tool is advanced to the blockage, is operated to remove the blockage and is retracted from the supply line section and the solids injection lance.

The tool may comprise a drill head and a chill operably connected to the drill head to cause the drill head to rotate.

The advancing assembly may comprise a number of drill bar extensions that are sequentially connectable to extend the length of the operating connection between the drill and the drill head.

The advancing means may further comprise a driver for advancing and retracting the drill head and drill bar extensions within the solids injection lance.

The driver may be a rail-mounted car to which the drill is mounted for reciprocal movement co-axial with the solids injection lance and the drill bar extensions include interconnecting links such that reciprocal movement of the rail-mounted car causes a corresponding movement of the drill bar extensions and the drill.

The apparatus may further comprise an isolation valve upstream of the lance to enable the tool to be introduced to and retrieved from the solids injection lance under atmospheric pressure.

BRIEF DESCRIPTION OF THE DRAWINGS

The invention is described further, by way of example only, with reference to the accompanying drawings, of which.

DESCRIPTION OF EMBODIMENTS

Figure 1:
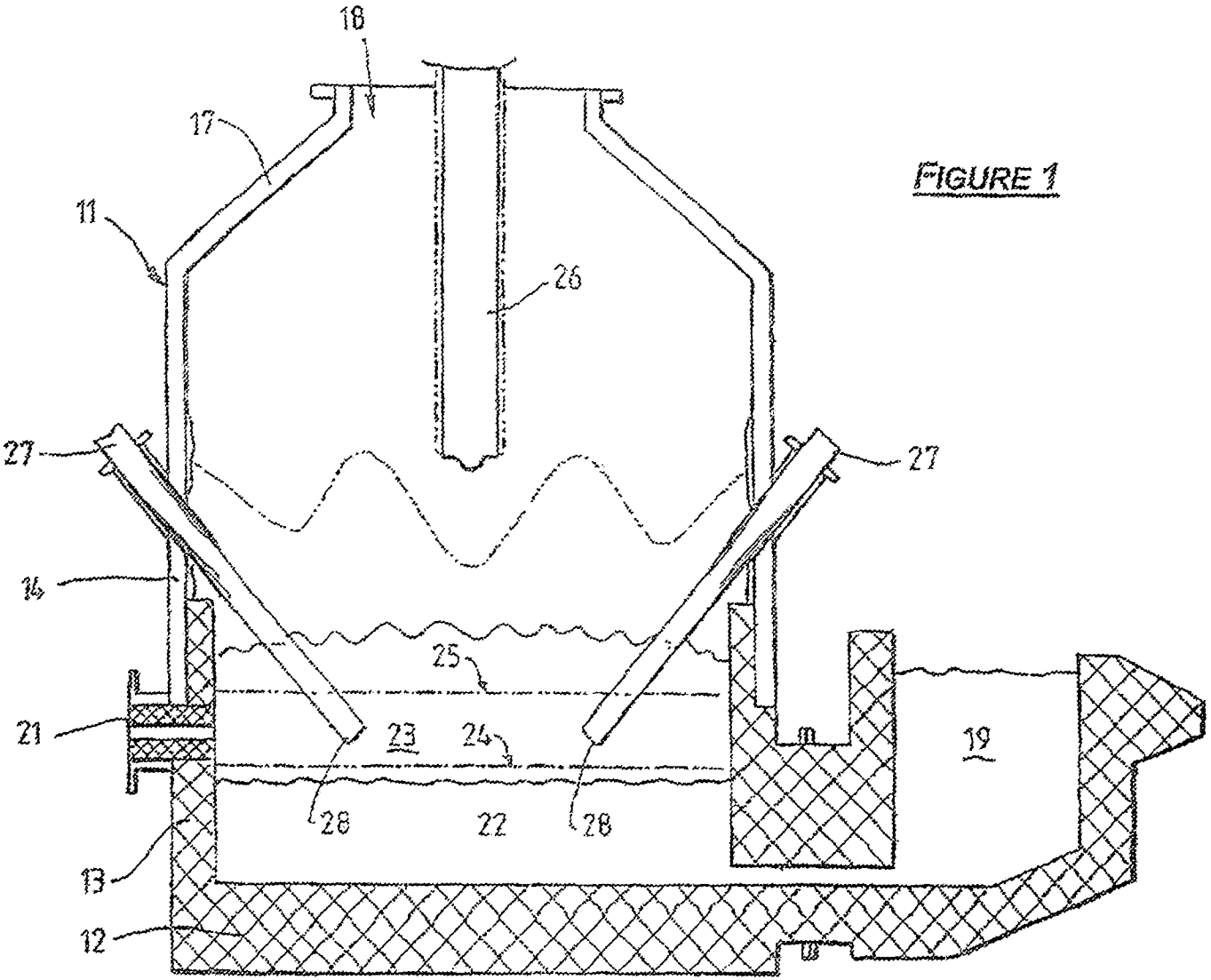
FIG. 1 is a vertical cross-section through a direct smelting vessel that forms part of an embodiment of a direct smelting plant in accordance with the present invention.

FIG. 1 shows a direct smelting vessel 11 that is suitable particularly for carrying out the HIsmelt process as described by way of example in international patent application PCT/AU96/00197 (WO 1996/031627) in the name of the applicant.

The following description is in the context of smelting iron ore fines to produce molten iron in accordance with the HIsmelt process.

It will be appreciated that the present invention is applicable to smelting any metalliferous material, including ores, partly reduced ores, and metal-containing waste streams via any suitable molten bath-based direct smelting process and is not confined to the HIsmelt process. It will also be appreciated that the ores can be in the form of iron ore fines.

The vessel 11 has a hearth that includes a base 12 and sides 13 formed from refractory bricks, side walls 14, which form a generally cylindrical barrel extending upwardly from the sides 13 of the hearth, and a roof 17. Water-cooled panels (not shown) are provided for transferring heat from the side walls 14 and the roof 17. The vessel 11 is further provided with a forehearth 19, through which molten metal is continuously discharged during smelting, and a tap-hole 21, through which molten slag is periodically discharged during smelting. The roof 17 is provided with an outlet 18 through which process off gases are discharged.

In use of the vessel 11 to smelt iron ore fines to produce molten iron in accordance with the HIsmelt process, the vessel 11 contains a molten bath of iron and slag, which includes a layer 22 of molten metal and a layer 23 of molten slag on the metal layer 22. The position of the nominal quiescent surface of the metal layer 22 is indicated by arrow 24. The position of the nominal quiescent surface of the slag layer 23 is indicated by arrow 25. The term "quiescent surface" is understood to mean the surface when there is no injection of gas and solids into the vessel 11. Under normal operating conditions, the process operates in a range of pressures between 0.5 Barg and 1.2 Barg, and preferably between 0.6 to 1.0 Barg.

The vessel 11 is provided with solids injection lances 27 that extend downwardly and inwardly through openings (not shown) in the side walls 14 of the vessel and into the slag layer 23. The solids injection lances 27 are described in more detail in relation to FIGS. 3 and 4. Two solids injection lances 27 are shown in FIG. 1. However, it can be appreciated that the vessel 11 may have any suitable number of such lances 27. In use, heated iron ore fines and ambient temperature coal (and fluxes, typically lime) are entrained in a suitable carrier gas (such as an oxygen-deficient carrier gas, typically nitrogen) and are separately supplied to the lances 27 and co-injected through outlet ends 28 of the lances 27 into the molten bath and preferably into metal layer 22. The following description is in the context that the carrier gas for the iron ore fines and coal is nitrogen.

The outlet ends 28 of the solids injection lances 27 are above the surface of the metal layer 22 during operation of the process and are submerged in the slag layer 23. This position of the lances 27 reduces the risk of damage through contact with molten metal and also makes it possible to cool the lances by forced internal water cooling, as described further below, without significant risk of water coming into contact with the molten metal in the vessel 11.

The vessel 11 also has a gas injection lance 26 for delivering a hot air blast into an upper region of the vessel 11. The lance 26 extends downwardly through the roof 17 of the vessel 11 into the upper region of the vessel 11. In use, the lance 26 receives an oxygen-enriched hot air flow through a hot gas delivery duct (not shown), which extends from a hot gas supply station (also not shown).

Figure 2:
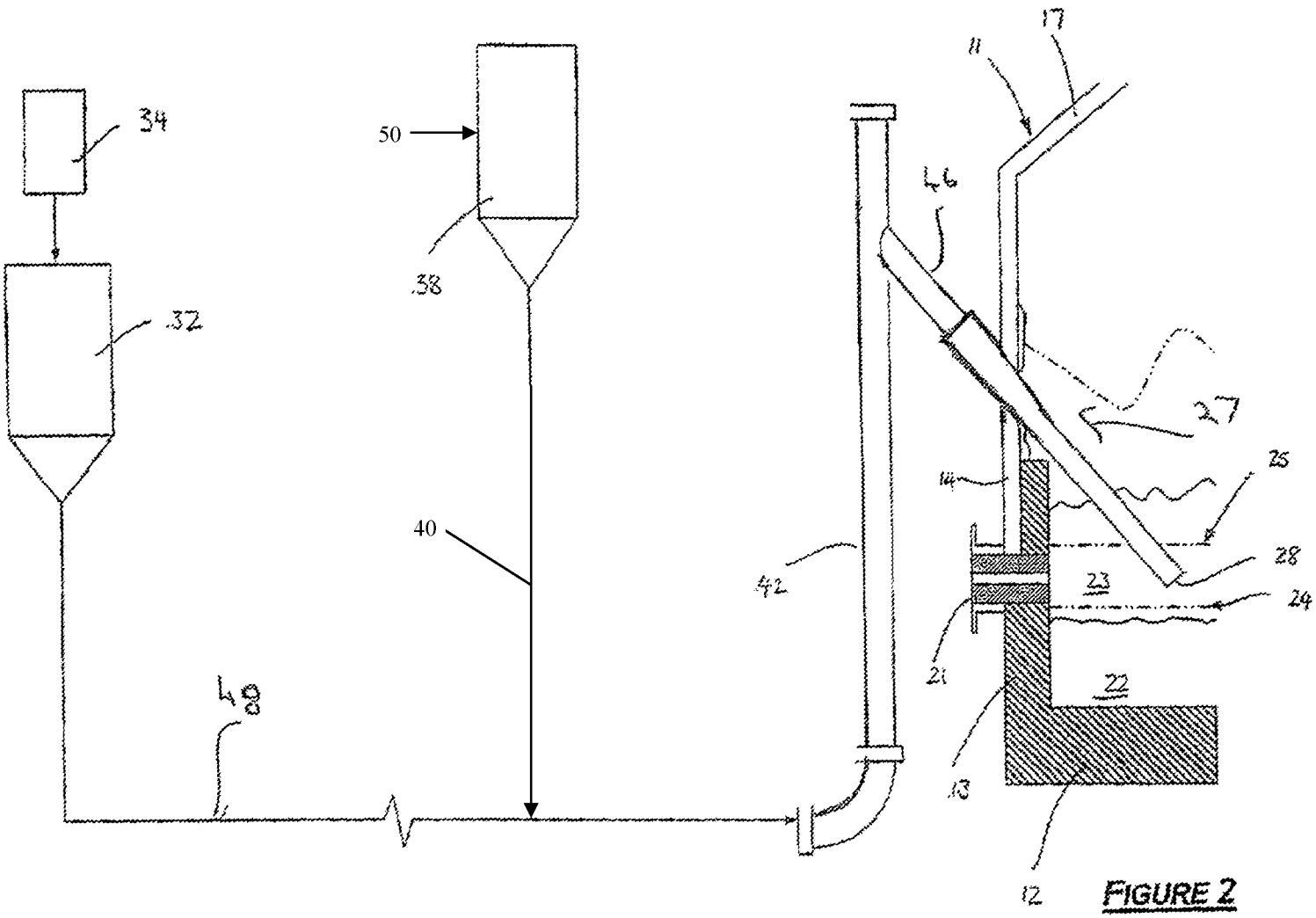
FIG. 2 is a schematic view that illustrates a metalliferous material and carbonaceous material injection system that supplies entrained solids material to a solids injection lance of a direct smelting vessel

FIG. 2 shows schematically one embodiment of a direct smelting plant in accordance with the invention insofar as the plant is concerned with supplying heated iron ore fines and ambient temperature coal to one solids injection lance 27.

The plant includes the direct smelting vessel 11 shown in FIG. 1.

The plant also includes a pre-treatment unit 34 in the form of a pre-heater for heating iron ore fines, typically to a temperature of at least 600° C. The pre-heater may be any suitable type of pre-heater.

The plant also includes an ore delivery system for supplying iron ore fines to the lances 27.

The ore delivery system includes (a) an ore storage/dispensing unit 32 for storing and dispensing heated iron ore fines and (b) an ore supply line 36 for supplying heated ore from the ore storage/dispensing unit 32 to the lances 27.

The ore storage/dispensing unit 32 is constructed to store and dispense heated iron ore fines entrained in nitrogen carrier gas. The ore storage/dispensing unit 32 can be in the form of a plurality of bins that allow heated iron ore fines to be transferred from standard atmospheric conditions to an environment of pressurized carrier gas. However, for the purposes of the present invention, the ore storage/dispensing unit 32 can be considered as a single unit. The carrier gas is pressurised so that the pressure drop from an inlet end 29 of the solids injection lance 27 to the outlet end 28 is at least 1 bar.

In use, iron ore fines are fed to the pre-heater 34 from a stockpile (not shown) and the pre-heater heats the fines. The pre-heater 34 is arranged to heat the fines such that the fines are at a temperature of at least 500° C. and typically of the order of 600° C. to 700° C. at the point of injection into the vessel 11. Off gases can be supplied from the outlet 18 to the pre-heater 34, such that heat can be transferred from the off gases to the iron ore fines. The pre-heater 34 is arranged to supply the heated iron ore fines to the ore storage/dispensing unit 32.

The ore supply line 36 for transporting heated iron ore fines from the storage/dispensing unit 32 to the lance 27 includes (a) a first section 48 that carries the fines to a location proximate the vessel 11, (b) an upwardly extending section 42 which conveys the fines from a position that is approximately level with the base 12 of the vessel 11 to at least the height of the lance 27, and (c) a downwardly extending section 46 which connects the line to an ore inlet in the lance 27. The section 46 is formed to be co-axial with the lance 27 when in an operating position as shown in FIG. 2 and defines a single passage that conveys gas and solids to an inlet end 29 of the solids injection lance 27. In other words, the section 46 does not include branch connections that connect with additional sources of gas or solids.

The plant also includes a separate coal delivery system for supplying coal to the lance 27.

The coal delivery system is in the same form as the ore delivery system described above with the exception that the coal is not pre-heated before supply to lance 27. Additionally, the coal delivery system typically supplies coal and flux material, such as lime.

The coal is delivered from a stockpile to a coal storage/dispensing unit 38 which stores the coal under ambient temperature. Flux 50 is supplied separately to the coal storage/dispensing unit 38. A supply line 40 connects the coal storage/dispensing unit 38 to the ore supply line 36. In the case of the ore being pre-heated, the supply line 40 delivers the coal and flux into the section 46. In each case, however, the solids injection lance 27 has a single inlet that is coupled to the section 46 which, itself, has a single passage for solids and gas. This means that there is, in effect, a single supply of solids and gas to the solids injection lance 27. For simplicity, however, the supply line is shown in FIG. 2 as delivering coal and flux into the first section 48 of the ore supply line 36.

In use, coal and flux at ambient temperature are discharged from the coal storage/dispensing unit 38 entrained in nitrogen carrier gas and transferred via the coal supply line 40 into the first section 48 of the ore supply line 36 so that the ore and the coal are carried together into the lance 27.

The coal storage/dispensing unit 38 can be in the form of a plurality of bins that allow coal to be transferred from standard atmospheric conditions to an environment of a pressurized nitrogen carrier gas. However, for the purposes of the present invention, the coal storage/dispensing assembly 38 can be considered to be a single unit.

Figure 3:
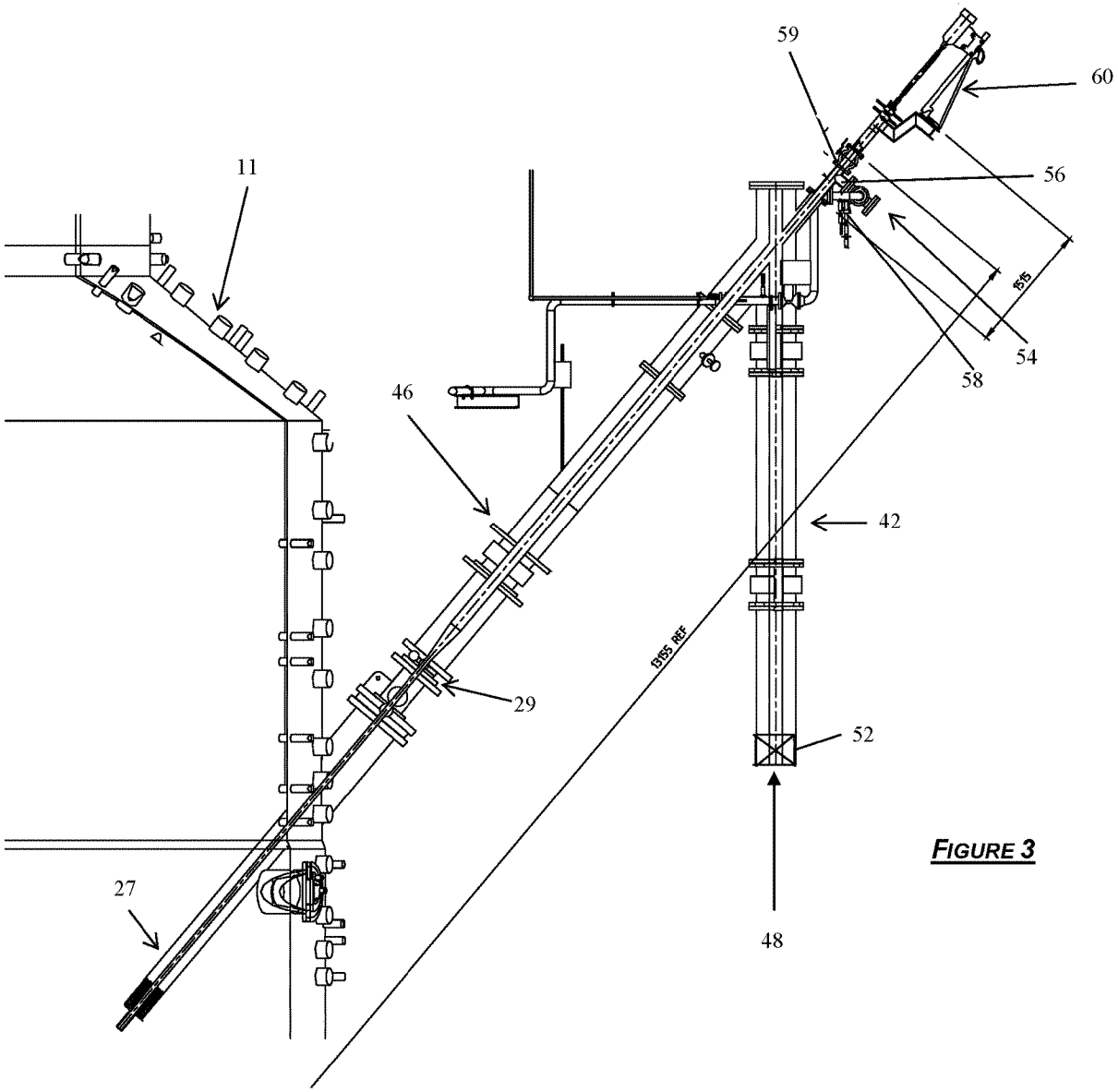
FIG. 3 is a schematic view of a solids injection lance and a supply line with an embodiment of the above mentioned apparatus for removing blockages.
Figure 4:
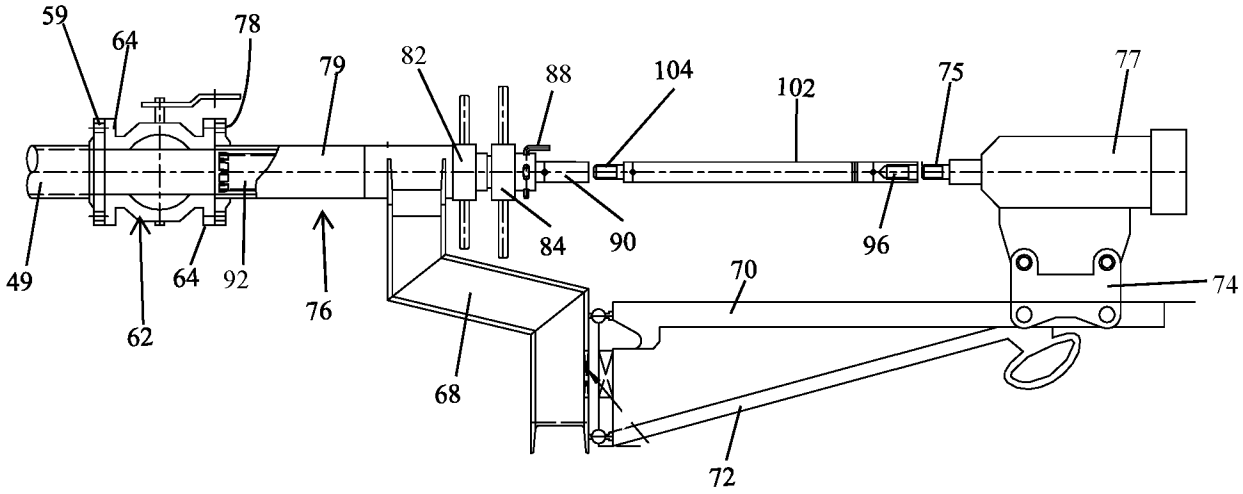
FIG. 4 is side plan view of the apparatus for removing blockages shown in FIG. 3, with a drill housing partially cut-away showing a drill head inside the drill housing.

The lance-end of the ore supply line 36 is shown in FIG. 3 with a blockage removing apparatus in the form of lance drilling assembly 60. The sections 42 and 46 of the ore supply line 36 have the same internal diameter for conveying entrained solid materials to the solids injection lance 27. An upper end of the section 46 extends upwardly and outwardly beyond the line of the section 42 to a lance purge system 54 that is operable to remove solids and gas from within the sections 42 and 46. The lance purge system 54 includes a take-off line 56 extending initially perpendicularly from the upper end of section 46 and further includes a venting valve 58 that controls the flow of gas and solids through the take-off line 56. The uppermost end of the section 46 terminates at a flange 59 (FIG. 4) to which the lance drilling assembly 60 can be mounted.

Figure 5:
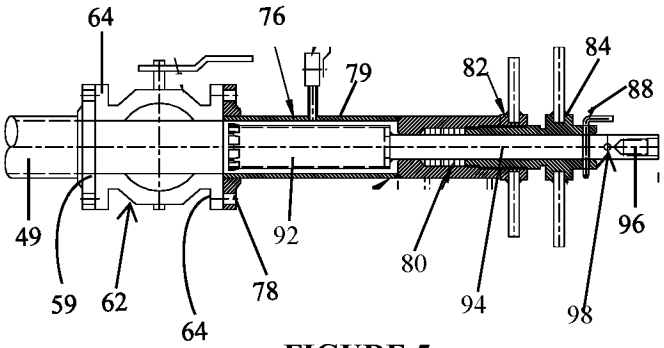
FIG. 5 is a cross-sectional view of a ball valve and drill housing shown in FIG. 4 along a longitudinal axis of the drill housing.

The lance drilling assembly 60 includes a ball valve 62 with flanges 64 disposed at each end. One flange 64 is connected to the flange 59 of the first section 46 and the other flange 64 is connected to an end flange 78 of a drill housing 76. A drill bar 90 (FIGS. 5 and 6A) is contained within the drill housing 76. A body 94 of the drill bar 90 is contained in a sleeve section 79 of the drill housing 76. A gland bar 84 has an series of handles and an external thread that co-operates with an internal thread of the sleeve section 79. Rotation of the gland bar 84 relative to sleeve section 79 advances the gland bar 84 within the sleeve 79 and compacts a graphite gland 80 which causes it to form a gas-tight seal around the internal wall of the sleeve section 79 and around the external wall of the body 94 of the drill bar 90. A locking bar 82 is provided with an internal thread that co-operates with the external thread of the gland bar 84. When a gas-tight seal is formed by the gland bar 84 compressing the graphite gland 80, the locking bar 82 is advanced along the thread on the gland bar 84 until it is tightened fast against the sleeve section 79. This stops the gland bar 82 from becoming loose during drilling position. When the lance drilling assembly 60 is not in operation, the ball valve 62 is closed to isolate the lance drilling assembly 60 from the ore supply line 36. Additionally, the drill bar 90 is retained in the housing 76 with a retaining pin 88 passing through the gland bar 84 and a retaining hole 100 in the drill bar 90.

Extending from the drill housing 76 is a support frame assembly 66 which comprises a zig-zag, shaped mounting arm 68, a drill support rail 70 extending parallel to the drill housing 76 and a brace 72 extending between the mounting arm 68 and the drill support rail 70. A car 74 is mounted to the drill support rail 70 to travel freely along the rail 70. A drill 77 is mounted to the car 74 and has a drill head 75 having an axis of rotation that is coaxial with the section 46 and the solids injection lance 27.

The drill bar 90 includes a hollow cylindrical head 92 extending forwardly of the body 94 and has teeth extending from the head 92 for cutting into a blockage in the solids injection lance 27. The hollow cylindrical head 92 causes drilling of the blockage to occur adjacent an inner wall of a conveying tube in the solids injection lance 27. Drilling in this location dislodges tines from the blockage and will tend to weaken the blockage at an interface with the inner side wall of the solids injection lance 27. Accordingly, it is expected that the blockage will fall away from the side wall and the fines will flow into the direct smelting vessel 11 with a purge gas.

Figure 6B:
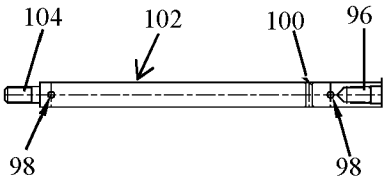
FIGS. 6A and 6B are side plan views of a drill head and an extension bar shown in FIG. 4.
Figure 6A:
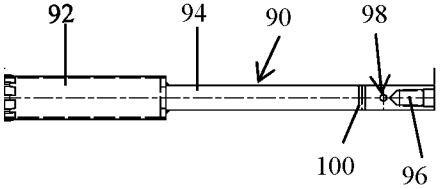

The body 94 includes a connection recess 96 in the end of the drill bar opposite to the head 92. The connection recess 96 has a profile corresponding to the profile of a connection lug 104 on an extension bar 102 (FIG. 6B). Both the drill bar 90 and the extension bar 102 include a connection hole 98 adjacent the respective connection recess 96 and connection lug 104. A link pin (not shown) is used to link adjacent extension bars 102 and to link an extension bar 102 to the body 94. Specifically, the link passes through the connection hole 98 on each adjacent extension bar 102 or body 94.

The retaining holes 100 accommodate the retaining pin 88 so that extension bars 102 and the drill bar 90 can be locked relative to the housing 76 while further extension bars 102 are added or removed as the drill bar 90 is advance or retracted. Specifically, in the course of retracting the drill bar 90, the gas pressure in the section 46 will tend to force the drill bar 90 and extensions 102 out of the section 46. Accordingly, each extension bar 102 is locked by the retaining pin 88 with the gland bar 84 while the drill 77 is connected to the extension bar 102. When that connection is made, the retaining pin 88 is removed and the drill 77 and car 74 controls the extraction of the extension bar 102. The next consecutive extension bar 102 coming through the housing 76 will then be locked by the retaining pin 88 to the gland bar 84 while the drill 77 is further retracted and the exposed extension bar 102 is decoupled from the locked extension bar 102. the process is repeated until all extension bars are removed and the drill bar 90 is retained in the housing 76.

When a blockage occurs in the solids injection lance 27, the only access to the blockage is via the single inlet 29 in the solids injection lance 27. Given that removing the blockage in a timely manner is important, removing upstream sections of the supply line 48, such as section 46 and section 42, to access the inlet end 29 of the lance before removing the blockage and replacing the upstream sections after the blockage is removed would incur a considerable time penalty. For this reason, the blockage is removed without removing sections 42, 46 of the supply line. As a result, gas pressure control upstream of the blockage includes controlling the gas pressure in the section 46 upstream of the inlet end 29. Additionally, access to the blockage for the lance-drilling assembly 60 is limited to the access via the section 46 and the inlet end 29 of the lance.

When a blockage occurs in the solids injection lance 27, the supply of solids materials is cut off from the sections 42 and 46 by the blockage. To be more specific, the blockage prevents the flow of carrier gas which means that solids fall out of entrainment. However, the supply line 48, 42, 46 and the solids injection lance 27 upstream of the blockage remains pressurised at a pressure above the gas pressure in the direct smelting vessel under normal operating conditions.

In one embodiment, the lance drilling assembly 60 is advanced to the blockage, via the section 46 and the portion of the solids injection lance 27 that is upstream of the blockage. The assembly 60 is then operated to remove the blockage and, once the blockage is removed (whereon the carrier gas flows through the supply line 48, 42, 46 and into the vessel with solid materials entrained in the flowing gas), the assembly is retracted free of the section 46.

To be more specific, the lance drilling assembly 60 is then given access to the solids injection lance 27 by opening ball valve 62. The drill bar 90 is advanced along the section 46 by connecting a connection bar 102 to the rear end of the drill bar 90 by fitting the connection lug 104 into the connection recess 96 on the drill bar 90. The retaining pin 88 is removed from the drill bar 90 and placed in the connection hole 98 in the extension bar 102. The extension bar 102 is then advanced into the drill housing 76 up to the point where the retaining pin 88 abuts the gland bar 84. The process of connecting further extension bars 102 and advancing them into the drill housing 76 has the effect of advancing previous extension bars 102 and the drill bar 90 along the section 46 until the drill bar 90 reaches the blockage in the solids injection lance 27. At this point the gland bar 84 is rotated so that it advances within the sleeve section 79 to compact the graphite gland 80 and to form a gas-tight seal in the drill housing 76 about the extension bar 102. The locking bar 82 is then advanced to lock the gland bar 84 in position. The drill 77 is then advanced along the drill support rail 70 so that the drill head 75 engages a connection recess 76 on an extension bar 102 extending outwardly from the drill housing 76.

The drill 77 is then operated so that the drill bar drills through the blockage. Once the blockage is removed and the carrier gas flows through the section 46 and the solids injection lance 27, the drill 77 is retracted along the drill support rail 70 so that extension bars 102 can be retracted from the section 46 and sequentially removed until the drill bar 90 is contained within the drill housing 76. The retaining pin 88 is placed in the retaining hole 100 in the drill bar 90 to retain the drill bar 90 in the drill housing 76. The ball valve 62 is then closed to isolate the lance drilling assembly 60 from the section 46. At this stage, the gas pressure in the housing 76 is still at the elevated purge-gas pressure. Accordingly, the sleeve section 79 includes a bleed valve 81 for venting pressurised gas from the housing 76 in a controlled manner.

In an alternative embodiment, the blockage is removed by first closing valve 52 (shown schematically in FIG. 3). With the section 46 still pressurised, solids are purged from the section 46 by opening the venting valve 58 to allow solids and pressurised gas to pass through the take-off line 56 in the lance purge system 54. Opening the venting valve 58 depressurizes the section 46 upstream of the blockage and a portion of the section 42 downstream of the valve 52. In this embodiment, the section 46 and the portion of the section 42 are depressurized to ambient pressure.

The lance drilling assembly 60 is then advanced along section 46 so that the drill bar 90 reaches the blockage. This procedure is the same as described above for the previous embodiment.

The sections 42 and 46 and the solids injection lance 27 upstream of the blockage are then re-pressurised with inert purge gas, typically nitrogen gas. The pressure in the sections 42 and 46 and the solids injection lance 27 is equivalent to the gas pressure inside the direct smelting vessel plus at least an additional 10 kPa such that when the drill head 92 breaks through the blockage, the gas pressure upstream of the blockage is greater than the gas pressure within the direct smelting vessel plus the hydrostatic pressure of the slag 23 at the outlet end 28 of the lance 27 so that the purge gas flows through the section 46 and the solids injection lance 27 and into the direct smelting vessel. Slag is therefore prevented from flowing back into the solids injection lance once the blockage is removed and during the time to retract the drill bar 90 and extension bars 102 from the solids injection lance 27 and the section 46.

The purge gas is supplied to the section 46 and the solids injection lance 27 by closing the venting valve 58 and supplying the purge gas through the take-off line 56 into the section 46.

Once the blockage is removed and the purge gas flows through the gas section 46 and the solids injection lance 27, the drill 77 is retracted along the drill support rail 70 so that extension bars can be retracted from the section 46 and sequentially removed until the drill bar 90 is contained within the drill housing 76. The retaining pin 88 is placed in the retaining hole 100 in the drill bar 90 to retain the drill bar 90 in the drill housing 76. The ball valve 62 is then closed to isolate the lance drilling assembly 60 from the section 46. At this stage, the gas pressure in the housing 76 is still at the elevated purge-gas pressure. Accordingly, the sleeve section 79 includes a bleed valve 81 for venting pressurised gas from the housing 76 in a controlled manner.

The supply of solid material is recommenced by opening the valve 52 in section 42. The return of this supply enables the supply of purge gas via the take-off line 56 to be stopped.

Whilst a number of specific apparatus and method embodiments have been described, it should be appreciated that the apparatus and method may be embodied in many other forms.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the apparatus and method as disclosed herein.

The invention claimed is:

1. A method of removing a blockage in a solids injection lance under normal operating conditions of a direct smelting vessel containing a bath of molten metal and slag, wherein the solids injection lance extends into the direct smelting vessel and has an outlet end that is submerged in the molten metal and slag and has a single inlet coupled to a section of supply line that conveys carrier gas and solid feed material to the solids injection lance, the section of supply line is upstream and co-axial with the solids injection lance, the method comprising the following sequential steps:

(a) depressurising the solids injection lance and the supply line section upstream of the blockage;

(b) advancing a blockage-removing tool through the supply line section and through the solids injection lance to an upstream side of the blockage;

(c) re-pressurising the solids injection lance and the supply line section to create elevated gas pressure conditions; and (d) operating the tool to remove the blockage, wherein the tool is operated in reciprocal movement co-axially within the solids injection lance such that solid feed material and carrier gas are able to flow through the solids injection lance and into the direct smelting vessel, while maintaining the elevated gas pressure conditions in the solids injections lance and upstream of the blockage; wherein the elevated gas pressure conditions are provided by ceasing supply of the carrier gas and then supplying a pressurised purge gas to the solids injection lance upstream of the blockage such that, upon removal of the blockage, the purge gas flows into the direct smelting vessel thereby preventing slag from entering the outlet end of the solids injection lance; and (e) retracting the tool from the solids injection lance and the supply line section.

2. The method defined in claim 1, wherein, under normal operating conditions, the solids injection lance is supplied with the solid feed material entrained in the carrier gas at a pressure higher than a gas pressure in the direct smelting vessel and the method includes maintaining the supply of the carrier gas so that the supply line section and the lance upstream of the blockage remain at a pressure higher than the gas pressure in the direct smelting vessel.

3. The method defined in claim 1, wherein the method further comprises re-commencing the supply of the carrier gas after the blockage is removed and reducing and ultimately ceasing the supply of the purge gas after commencing supply of the carrier gas.

4. The method defined in claim 1, wherein re-pressurising the solids injection lance and the supply line section comprises supplying the purge gas to the supply line section and to the solids injection lance upstream of the blockage.

5. The method defined in claim 1, wherein re-pressurising the solids injection lance and the supply line section comprises re-commencing supply of the carrier gas.

6. The method defined in claim 1, wherein the pressure in the direct smelting vessel is, under normal operating conditions, between 0.5 barg and 1.2 barg.

7. The method defined in claim 1, wherein the tool is a drill and the method involves removing the blockage by drilling through the blockage.

8. The method defined in claim 6, wherein removing the blockage involves drilling into the blockage adjacent an internal side wall of the solids injection lance to weaken the blockage at an interface with the side wall.

9. The method defined in claim 1, wherein step (b) involves connecting the tool to a series of extension bars and advancing the bars into the supply line section and the solids injection lance until the tool reaches the blockage.

10. The method defined in claim 1, wherein the solid feed material includes metalliferous material.

11. The method defined in claim 1, wherein the solid feed material includes carbonaceous material.

* * * * *